US007570914B2

(12) United States Patent
Kim et al.

(10) Patent No.: US 7,570,914 B2
(45) Date of Patent: Aug. 4, 2009

(54) IMAGE FORMING APPARATUS AND A PAPER FEEDING APPARATUS FOR THE SAME

(75) Inventors: Hyun-ho Kim, Seoul (KR); Joo-hwan Noh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 280 days.

(21) Appl. No.: 11/242,083

(22) Filed: Oct. 4, 2005

(65) Prior Publication Data

US 2006/0072951 A1 Apr. 6, 2006

(30) Foreign Application Priority Data

Oct. 6, 2004 (KR) ..... 10-2004-0079344

(51) Int. Cl.
*G03G 15/00* (2006.01)

(52) U.S. Cl. ..... 399/388; 399/395; 399/396; 400/624; 492/16; 492/18; 101/118

(58) Field of Classification Search ..... 399/388, 399/395, 396, 397; 400/624; 492/16, 18; 101/118

See application file for complete search history.

(56) References Cited

U.S. PATENT DOCUMENTS 5,493,968 A * 2/1996 Ishikawa ..... 101/118
6,175,706 B1 * 1/2001 Watanabe et al. ..... 399/167
6,540,219 B1 * 4/2003 Naruse et al. ..... 271/37

FOREIGN PATENT DOCUMENTS

| | | |
|---|---|---|
| CN | 1179559 | 4/1998 |
| JP | 06-286904 | 10/1994 |
| JP | 11-095639 | 4/1999 |
| JP | 11-352750 | 12/1999 |
| JP | 2001-051523 | 2/2001 |

* cited by examiner

*Primary Examiner*—Ren Yan
*Assistant Examiner*—Andy L Pham
(74) *Attorney, Agent, or Firm*—Roylance, Abrams, Berdo & Goodman, L.L.P.

(57) ABSTRACT

An image forming apparatus feeds a paper picked up by a pickup roller directly to a photoconductive drum and controls a linear velocity of the pickup roller so that it is slower than that of the photoconductive drum. The different linear velocities of the pickup roller and the photoconductive drum produces different velocities at the transfer nip (the area of contact between the photoconductive drum and a transferring roller) and the point where paper is picked up by the pickup roller. To compensate for the different velocities, the pickup roller can be rotated faster than the photoconductive drum for an angle that corresponds to the velocity difference. Additionally, when a velocity difference occurs between two rollers for feeding the paper, one of the rollers can be further rotated to compensate for the velocity difference.

6 Claims, 8 Drawing Sheets

IMAGE FORMING APPARATUS AND A PAPER FEEDING APPARATUS FOR THE SAME

CROSS-REFERENCE TO RELATED APPLICATIONS

This application claims the benefit under 35 U.S.C. § 119 (a) of Korean Patent Application No. 2004-79344, filed Oct. 6, 2004, the entire contents of which are incorporated herein by reference.

BACKGROUND OF THE INVENTION

1. Field of the Invention

The present invention relates to an image forming apparatus and a paper feeding mechanism for the same. More particularly, the present invention relates to a paper feeding mechanism for an image forming apparatus that is capable of compensating for differences in the velocities of rollers that convey paper.

2. Description of the Related Art

Generally, in an electrophotographic image forming apparatus such as a laser printer, an electrostatic latent image is formed on a photoconductive medium, such as a photoconductive belt or drum, and the electrostatic latent image is developed using developer of a certain color and transferred onto paper, thereby producing a desired image.

FIG. 1 schematically shows a printing process in a conventional image forming apparatus 1. Referring to FIG. 1, the surface of a photoconductive drum 3 is evenly charged by an electrifying roller 2. The photoconductive drum 3 is exposed to a laser beam generated by a laser scanning unit 5 to form an electrostatic latent image. The electrostatic latent image is developed using toner into a visible image by a developing roller 7 that rotates in contact with the photoconductive drum 3.

Paper stacked on a paper supply part 9 is supplied to a feeding roller 13 by a pickup roller 11 and conveyed to a transferring roller 15 by rotation of the feeding roller 13. The developed toner image formed on the photoconductive drum 3 is transferred onto the paper by pressure generated by the transferring roller 15. The transferred toner image is fixed with a high temperature by a fixing roller 17 and conveyed toward a discharged-paper tray 21 by a discharging roller 18. As a result of these processes, a desired image is printed onto paper.

Conventional image forming apparatuses have been further developed to include dedicated paper supplying cassettes, such as a multistep paper supply, so that the paper supply capacity can be increased. Laid-Open Korean Patent Application No. 1998-020607(laid open on Jun. 25, 1998, and entitled "Feeding Device of Electrophotographic Process") discloses an example of such an image forming apparatus, and is hereby incorporated by reference in its entirety.

Recently, a variety of functions have been, and are being, added to a basic image forming apparatus, as disclosed in the above example. The addition of functions produces an added emphasis on making smaller, more compact products.

In a conventional image forming apparatus, however, it is difficult to reduce the size of the apparatus. One source of difficulty is the use of a dedicated feeding roller 13. The use of a dedicated feed roller, in combination with a pickup roller 11, to feed paper to the photoconductive drum 3, increases the length of the paper feeding path 23. Accordingly, the size of the entire apparatus is increased. Furthermore, the dedicated feeding roller 13 increases the number of parts in the apparatus, thereby increasing manufacturing costs.

SUMMARY OF THE INVENTION

An aspect of the present invention is to solve at least the above problems and/or disadvantages and to provide at least the advantages described below. Accordingly, an aspect of the present invention is to provide a smaller, more compact image forming apparatus by shortening the paper feeding path by directly conveying paper from a pickup roller to a transfer nip (that is, the contact point between a photoconductive drum and a transferring roller).

Another aspect of the present invention is to provide an image forming apparatus that reduces manufacturing cost by eliminating a feeding roller, thereby reducing the number of parts to manufacture and assemble.

A further aspect of the present invention is to provide, in an image forming apparatus that directly conveys paper from a pickup roller to a transfer nip, a mechanism for compensating for any velocity differences between the pickup roller and the photoconductive drum.

Yet another aspect of the present invention is to provide a paper feeding apparatus for an image forming apparatus that is capable of compensating for differences in the conveying velocity of feeding rollers.

According to an aspect of the present invention, an image forming apparatus comprises a photoconductive drum, a transferring roller pressed toward the photoconductive drum by a predetermined pressure to transfer an image formed on the photoconductive drum to paper, a paper supply part for stacking paper thereon, a pickup roller for picking up the paper from the paper supply part and conveying the paper directly to a nip between the photoconductive drum and the transferring roller, and a pickup shaft inserted in the pickup roller to rotate the pickup roller. When the linear velocity of the pickup shaft is less than that of the photoconductive drum, the pickup roller can be further rotated in the rotational direction of the pickup shaft after the paper enters the nip between the photoconductive drum and the transferring roller to compensate for the differences in velocity.

The pickup shaft can have a substantially polygonal cross-section, and a rotation space can be formed at an inner perimeter of the pickup roller to allow the pickup roller to be further rotated by a predetermined angle.

The pickup shaft can have a substantially polygonal cross-section, and the pickup roller can include an insertion member with a rotation space for allowing the pickup roller to be further rotated by a predetermined angle.

The predetermined angle can be equal to or greater than an angle corresponding to a difference in linear velocities between the pickup roller and the photoconductive drum.

The rotation space can be defined by curved surfaces formed by recessing an inner perimeter of the pickup roller or an inner perimeter of the insertion member corresponding to corner portions of the pickup shaft.

According to another aspect of the present invention, a paper feeding apparatus for an image forming apparatus comprises a first roller for conveying paper, a second roller disposed a predetermined distance away from the first roller to convey the paper subsequent to the first roller, and a rotation shaft inserted in the first roller to rotate the first roller. When the linear velocity of the second roller is greater than that of the first roller, and when the paper advances from the first roller to the second roller, the first roller can be further rotated in a rotational direction of the rotation shaft.

The rotation shaft can have a substantially polygonal cross-section, and a rotation space can be formed at an inner perimeter of the first roller to allow the first roller to be further rotated by a predetermined angle.

The rotation shaft can have a substantially polygonal cross-section, and the first roller can include an insertion member with a rotation space for allowing the first roller be further rotated by a predetermined angle.

The predetermined angle can be equal to or greater than an angle corresponding to a difference in linear velocities between the first roller and the second roller.

The rotation space can be defined by curved surfaces formed by recessing an inner perimeter of the second roller corresponding to corner portions of the rotation shaft or an inner perimeter of the insertion member corresponding to corner portions of the pickup shaft.

Consequently, in an image forming apparatus according to the embodiments of the present invention, the paper 101 that is picked up by the pickup roller 135 can be directly conveyed to the photoconductive drum 153. Therefore, the paper feeding path can be shortened, thereby reducing the size of the apparatus and the number of parts in the apparatus.

In addition, the embodiments of the invention compensate for any velocity differences between the transfer nip P1 and the pickup point P2, so that the paper can be conveyed at a uniform speed.

Furthermore, according to the image forming apparatus of the present invention, even when there is a velocity difference between two rollers, the velocity difference is compensated for by allowing one of the rollers to further rotate. Accordingly, the paper conveying operation is uniform.

BRIEF DESCRIPTION OF THE DRAWING FIGURES

The above and other objects, features, and advantages of certain embodiments of the present invention will be more apparent from the following description taken in conjunction with the accompanying drawings, in which.

Figure 8:
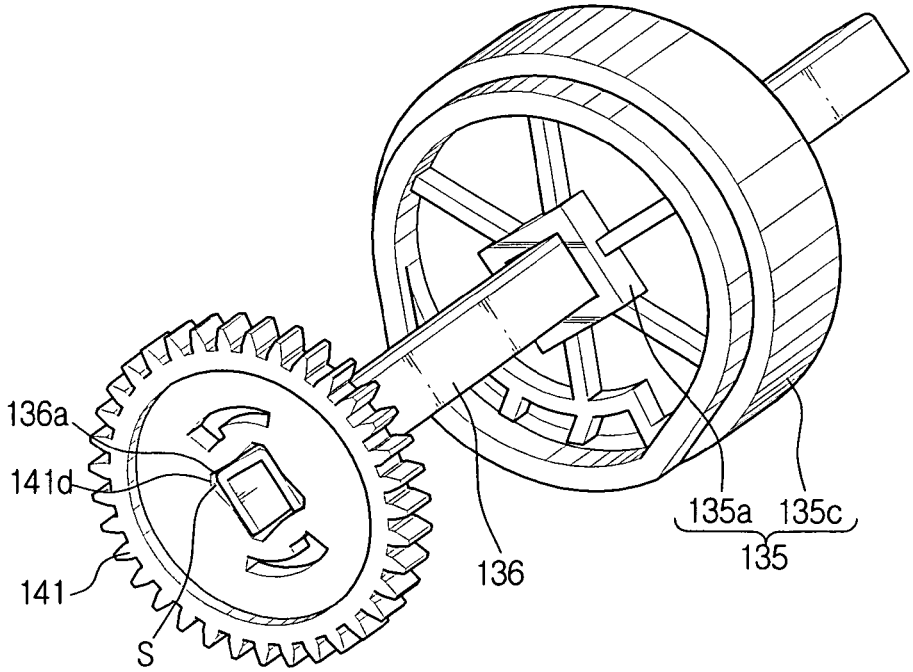
Figure 9:
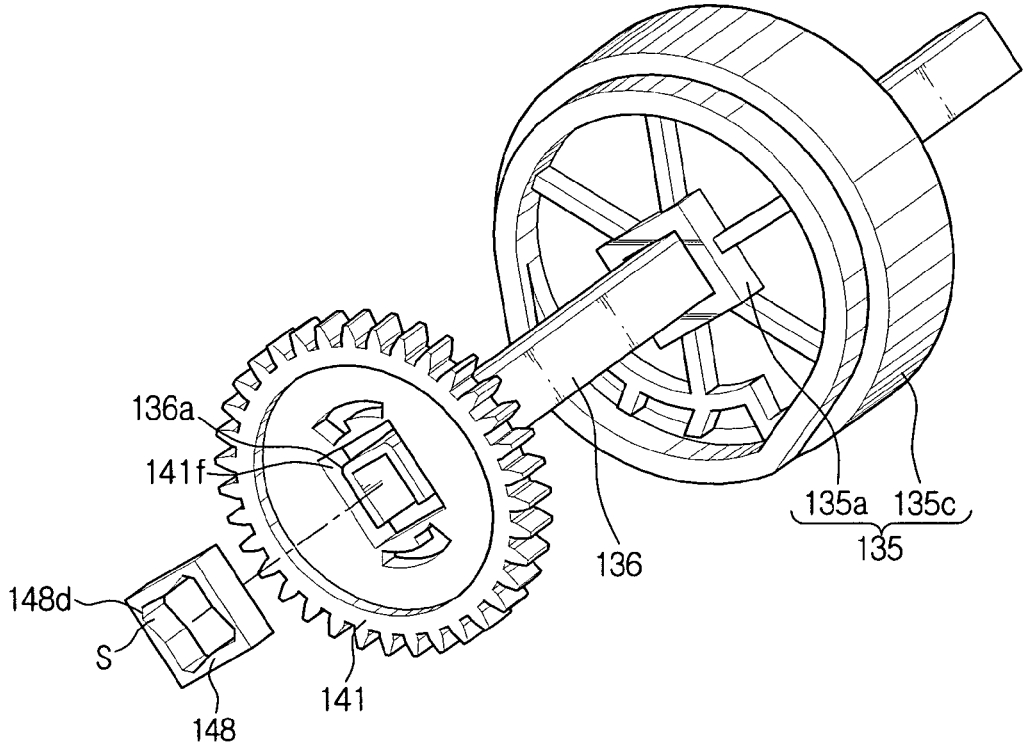

FIG. 8 is a perspective view of a velocity-difference controlling mechanism for controlling velocity differences between the photoconductive medium and the pickup roller, which is provided to a pickup gear and a pickup shaft connection part, according to another embodiment of the present invention; and FIG. 9 is a perspective view of a velocity-difference controlling mechanism with an insertion member according to another embodiment of the present invention.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
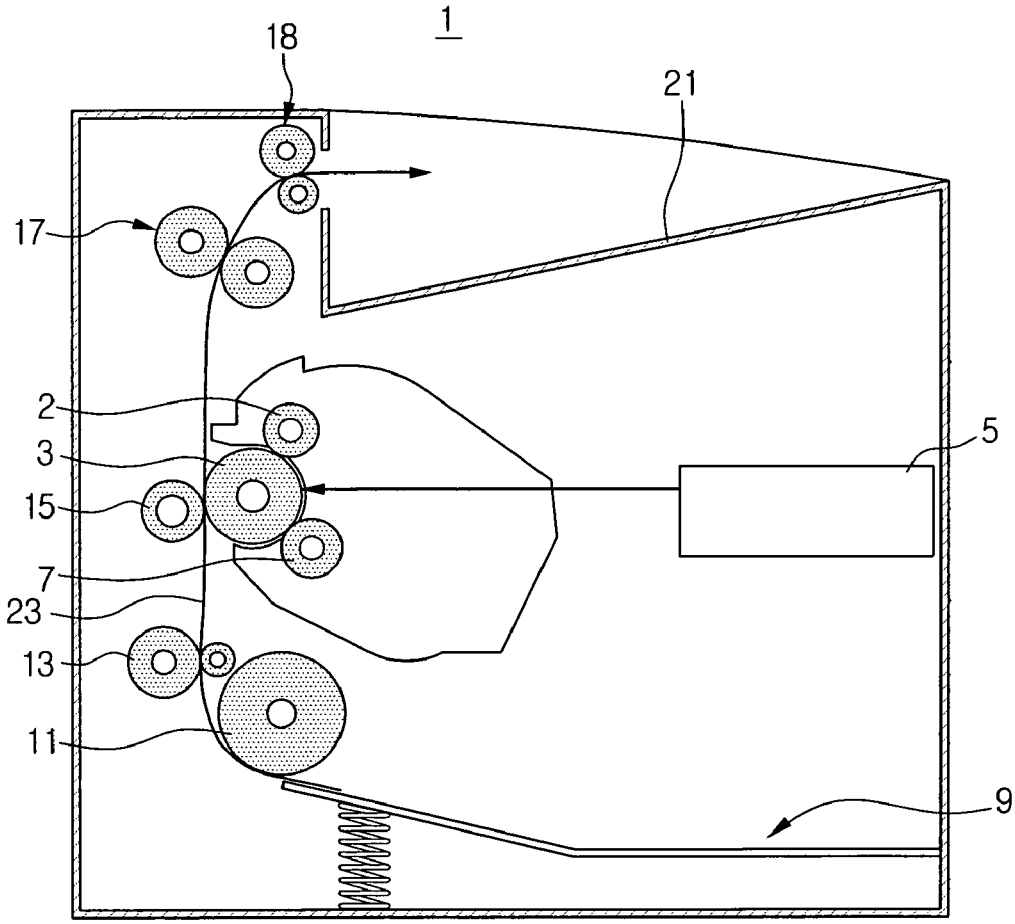
FIG. 1 (PRIOR ART)
FIG. 1 is a schematic view of a conventional electrophotographic image forming apparatus.
Figure 2:
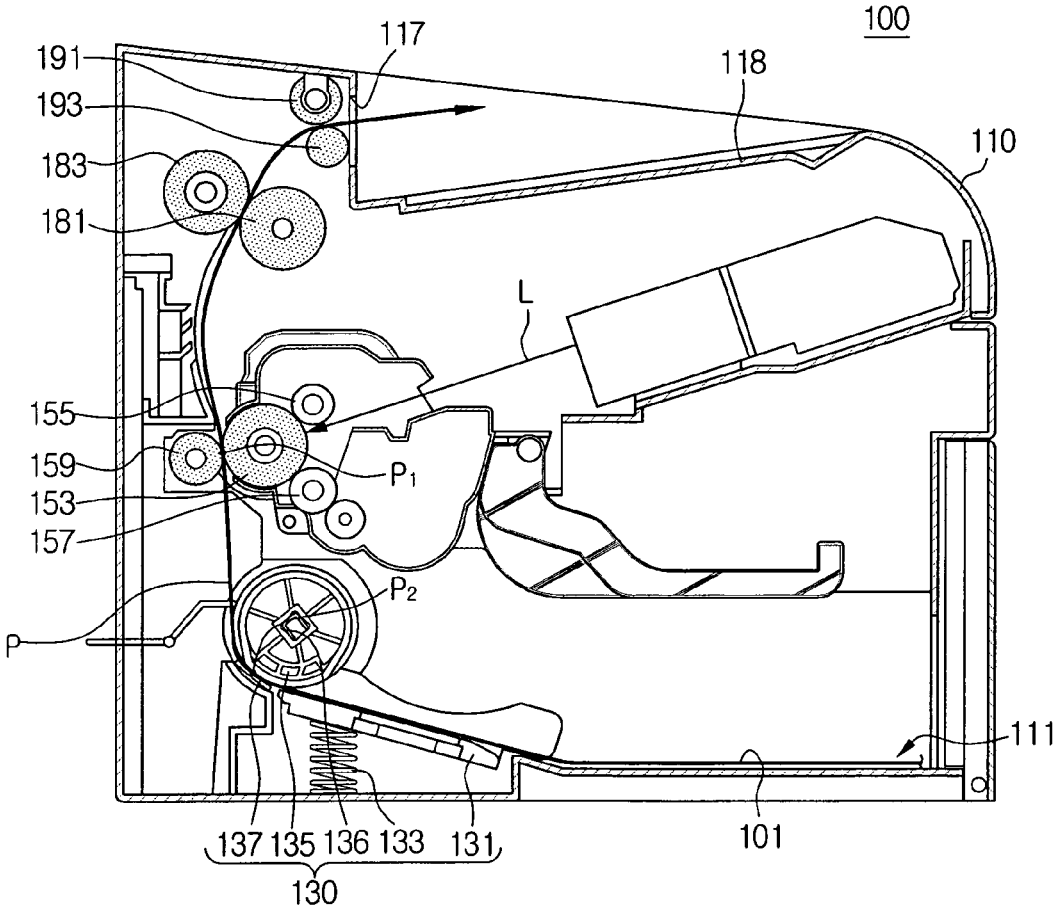
FIG. 2 is a sectional view of the structure of an image forming apparatus according to an embodiment of the present invention.

Referring to FIG. 2, a paper supply part 111 is formed on the inner surface of the bottom of a main body 110. A knockup plate 131 for stacking a plurality of papers thereon is provided at the paper supply part 111. A biasing member 133 is located between the knockup plate 131 and the main body 110. As a pickup roller 135 is rotated, paper 101 stacked on the knockup plate 131 is picked up sheet by sheet by friction generated by a friction pad 137. The paper is supplied to a transfer nip P1, which is the area of contact between a photoconductive drum 153 and a transferring roller 159.

At the same time, the surface of the photoconductive drum 153 is evenly charged by an electrifying roller 155. The electrically charged surface of the photoconductive drum 153 is exposed to a laser beam L irradiated from a laser scanning unit 170 in a predetermined pattern to produce an electrostatic latent image in a desired form. A developing roller 157, which is adjacent to the surface of the photoconductive drum 153, rotates and thereby develops the electrostatic latent image into a toner image. The transferring roller 159 rotates and presses against the photoconductive drum 153 to transfer the toner image formed on the photoconductive drum 153 onto the paper supplied by the paper supply part 130.

The paper 101 is conveyed to and passes through a space between a heating roller 181 and a pressing roller 183 to heat the paper to a predetermined temperature and fix the toner image onto the paper.

The paper with the fixed toner image is conveyed by a discharging roller 191 and an idle roller 193 to be discharged through an outlet 117 and stacked on a discharged-paper tray 118, thereby completing the printing operation.

When the paper 101 picked up by the pickup roller 135 is directly conveyed to the transfer nip P1, the linear velocity at the transfer nip P1 and the linear velocity at the pickup point P2 may differ. A mechanism for compensating for any differences between the velocities will now be described.

When the paper 101 picked up by the pickup roller 135 advances toward the photoconductive drum 153 as described above, a "flicker," or disruption, in the printed image may occur if the linear velocity of the photoconductive drum 153 and the linear velocity of the pickup roller 135 are different. To prevent such a disruption, which degrades the image quality, the relationship between the velocities needs to be controlled.

Figure 3:
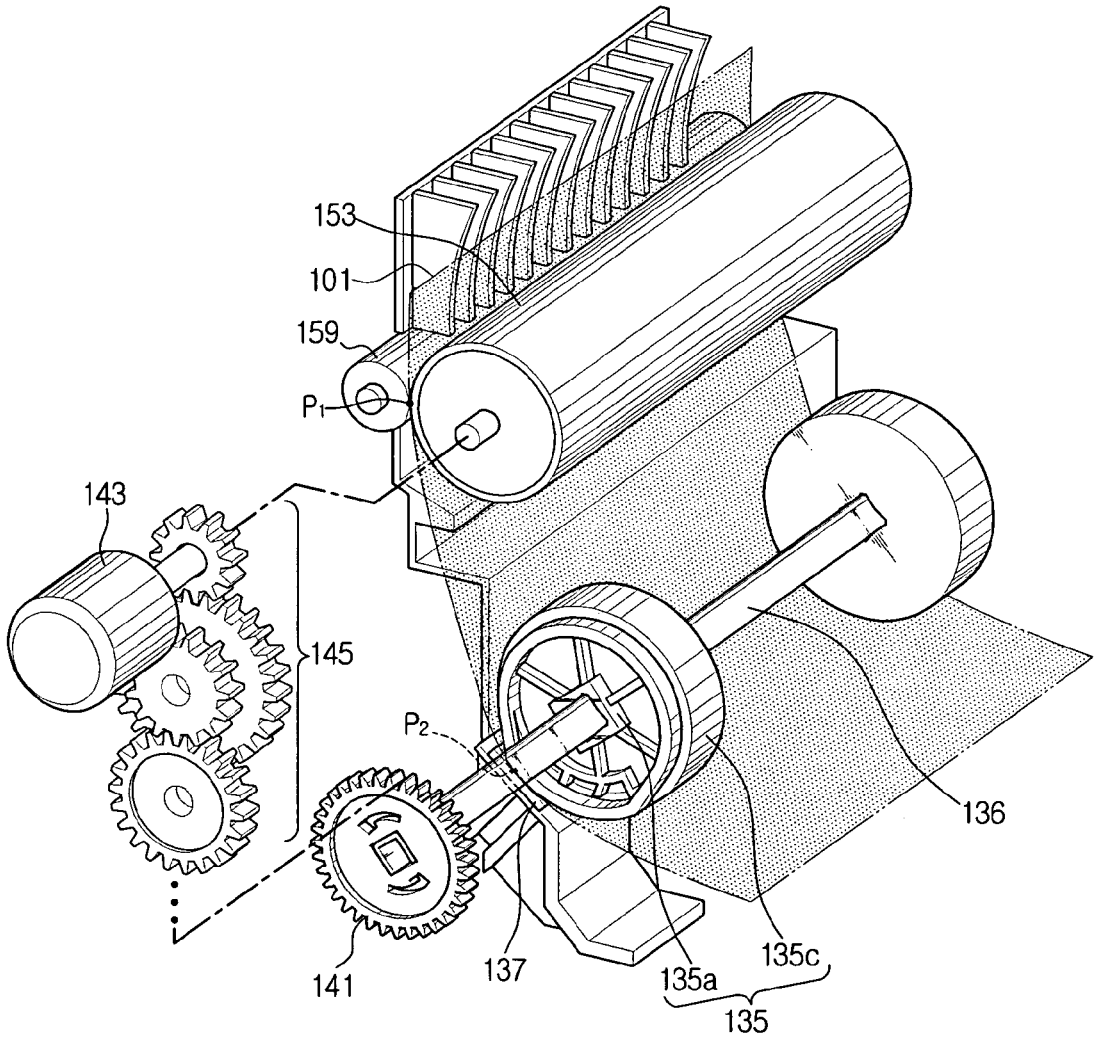
FIG. 3 is a perspective view of an image forming apparatus with a velocity-difference controlling mechanism for controlling velocity differences between a photoconductive drum and a pickup roller, according to an embodiment of the present invention.

FIG. 3 is a perspective view of an image forming apparatus with a mechanism for controlling the velocity difference between the photoconductive drum and the pickup roller, according to an embodiment of the present invention. FIG. 3 shows the photoconductive drum 153 rotating at a higher linear velocity than the pickup roller 135, which comprises a pickup housing 135*a* and a pickup rubber 135*c*. A pickup shaft 136 is inserted in the center of the pickup housing 135*a*. The pickup shaft 136 may have a polygonal cross-section, such as a square cross-section, to efficiently transmit rotational power. A pickup gear 141 is connected to the pickup shaft 136 to receive power from a driving motor 143 through a gear train 145 and thereby rotate the pickup shaft 136 at a predetermined velocity. The gear train 145 transmits power from the driving motor 143 to the respective rollers, such as the photoconductive drum 153, the transferring roller 159 and the pickup roller 135. The gear ratio of the gears is selected such that the rollers rotate at an appropriate velocity.

Figure 4:
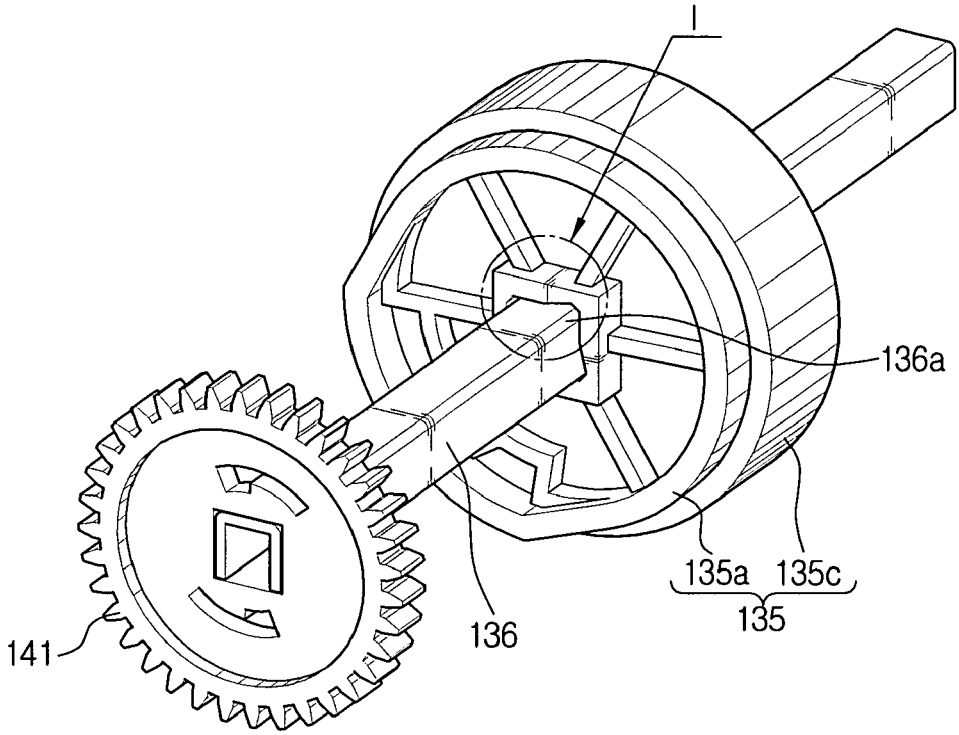
FIG. 4 is an enlarged, perspective view of the pickup roller of FIG. 3.
Figure 5:
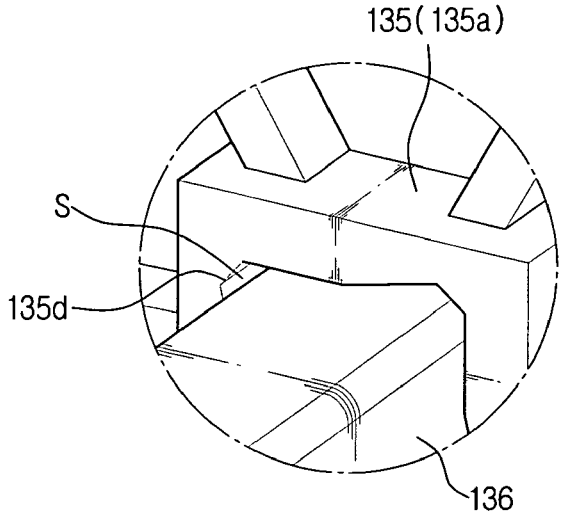
FIG. 5 is an enlarged view of the portion 'I' of FIG. 4.

FIG. 4 is an enlarged, perspective view of the pickup roller 135 of FIG. 3, and FIG. 5 is an enlarged view of a portion 'I' of FIG. 4. Referring to FIGS. 4 and 5, a rotation space S is formed at an inner perimeter of the pickup roller 135, where the pickup shaft 136 is inserted, so that the pickup roller 135 can rotate by a predetermined angle without interference by the corner portions 136*a* of the pickup shaft 136 which has a polygonal cross-section.

The rotation space S is defined by curved surfaces 135*d* formed by recessing the inner perimeter of the pickup housing 135*a* at areas corresponding to the corner portions 136*a* of the pickup shaft 136.

When the linear velocity of the photoconductive drum 153 is faster than that of the pickup roller 135, as the paper enters the transfer nip P1, a difference in the linear velocities is generated between the transfer nip P1 and the pickup point P2 of the pickup roller 135, as shown in FIG. 3. Therefore, the paper 101 is strained at the transfer nip P1. The strain causes the pickup roller 135 to rotate further than the pickup shaft 136 in a rotational direction of the pickup shaft 136. The rotation space S (FIG. 5) in the pickup roller 135 allows this further rotation. Thus, the difference in linear velocities between the photoconductive drum 153 and the pickup roller 135 can be compensated, thereby producing a more uniform paper conveying velocity at the transfer nip P1.

Figure 6A:
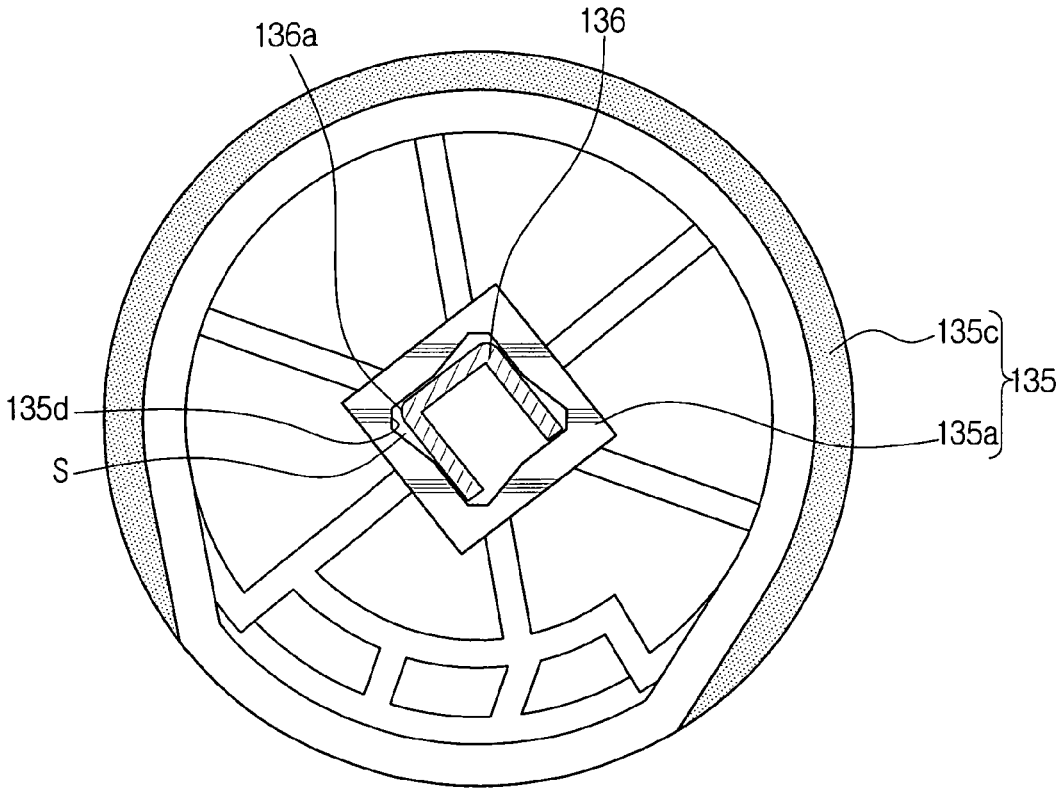
FIG. 6A shows the rotational position of the pickup shaft and pickup roller before paper enters a transfer nip, according to an embodiment of the present invention.

The principle of uniformly controlling the paper conveying velocity between the transfer nip P1 and the pickup point P2 will now be described in greater detail. FIG. 6A shows the rotational position of the pickup roller 135 before the paper 101 enters the transfer nip P1, according to an embodiment of the present invention. Referring to FIG. 6A, before the paper 101 picked up by the pickup roller 135 enters a transfer nip P1, the pickup roller 135 rotates together with the pickup shaft 136 at the same angular velocity as the pickup shaft 136.

Figure 6B:
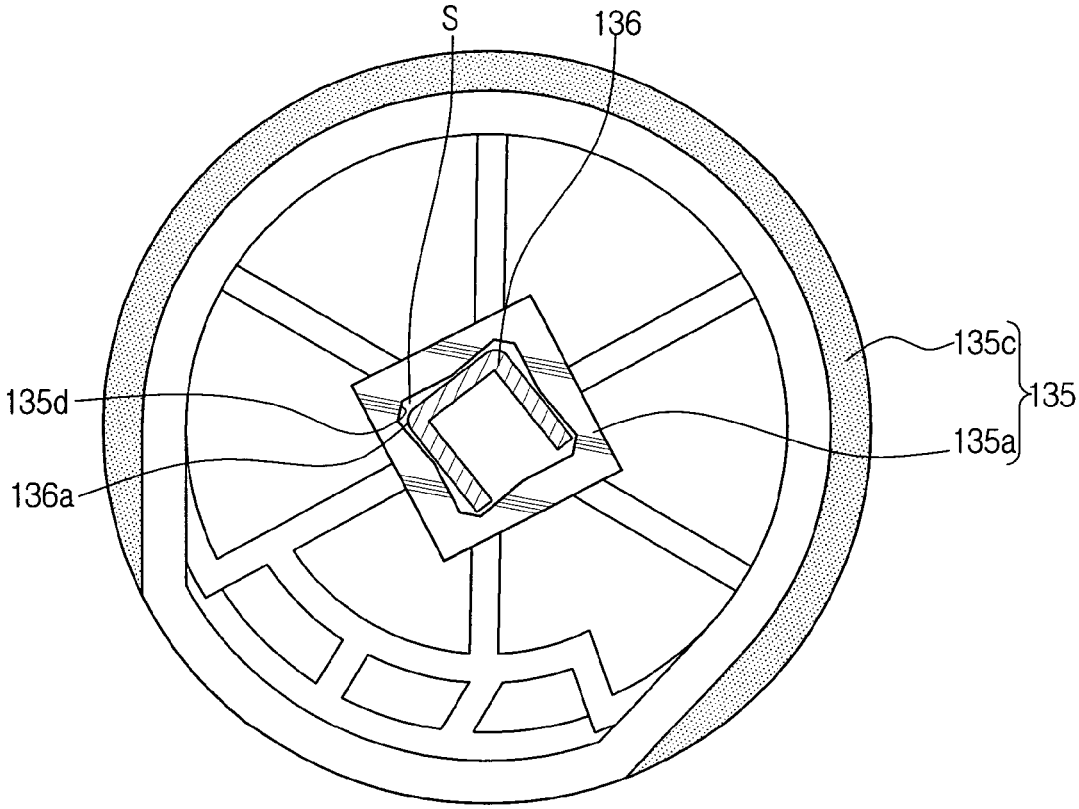
FIG. 6B shows the rotational position of the pickup shaft and pickup roller after the paper enters the transfer nip, according to an embodiment of the present invention.

FIG. 6B shows the rotational position of the pickup roller 135 after the paper 101 enters the transfer nip P1, according to an embodiment of the present invention. Referring to FIG. 6B, after the paper 101 enters the transfer nip P1, if the velocity of the photoconductive drum 153 and the transferring roller 159 (FIGS. 2 and 3) are different, the conveying force strains the paper 101 at the transfer nip P1. This strain causes the pickup roller 135 to rotate further than the pickup shaft 136 by as much as the differences in linear velocity. Due to the rotation space S formed by the curved surface 135*d* of the inner perimeter of the pickup roller 135, the pickup roller 135 can be rotated further than the pickup shaft by a predetermined amount. Thus, the velocity difference can be compensated, and, as a result, deterioration of image quality can be prevented.

The pickup roller 135 is rotated to the state shown in FIG. 6B while conveying one sheet of paper. When the pickup roller 135 picks up the next sheet of paper, the pickup roller momentarily remains stationary while the pickup shaft 136 rotates by a predetermined angle within the pickup roller 135, thereby returning to the state shown in FIG. 6A.

Figure 7:
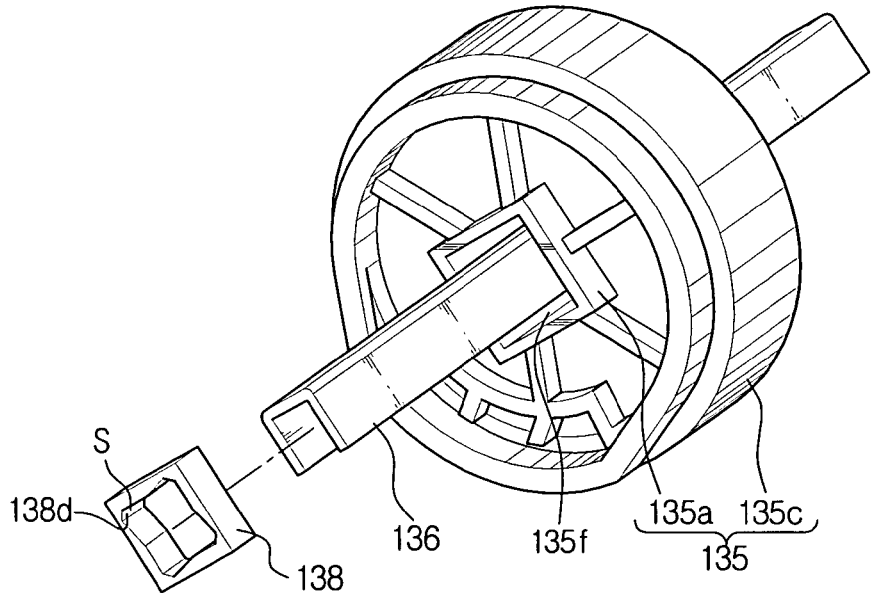
FIG. 7 is an enlarged, perspective view of a pickup roller with an insertion member, according to an embodiment of the present invention.

FIG. 7 shows a velocity-difference controlling mechanism which is provided as a dedicated part according to an embodiment of the present invention. Referring to FIG. 7, the rotation space S can be formed within the pickup roller 135 by adding an insertion member 138, instead of at the inner perimeter of the pickup roller 135. An inner perimeter of the insertion member 138 forms curved surfaces 138*d* configured in the same manner as the curved surfaces 135*d* of the pickup roller 135, thereby providing the rotation space S. A reserved space 135*f* for the insertion member 138 is formed in the pickup roller 135.

FIG. 8 shows a velocity-difference controlling mechanism for controlling a velocity difference between the photoconductive medium and the pickup roller according to another embodiment of the present invention. In this embodiment, the mechanism is provided at the connection of the pickup gear and the pickup shaft.

Referring to FIG. 8, the main components of this embodiment are almost the same as those shown in FIGS. 3 to 7. In this embodiment, however, the pickup shaft 136 is integrally formed with the pickup housing 135*a*, and the rotation space S is formed by curved surfaces 141*d* at the inner perimeter of the pickup gear 141 to compensate for the velocity difference between the pickup roller 135 and the photoconductive drum 153.

In the structure shown in FIG. 8, when the paper 101 enters the transfer nip P1, the linear velocity of the transfer nip P1 and the linear velocity of the pickup point P2 are different due to the conveying forces of the photoconductive drum 153 and the transferring roller 159 (FIGS. 2 and 3). Therefore, the pickup shaft 136 further rotates as much as the difference of the linear velocities between the photoconductive drum 153 and the pickup roller 135. Since the pickup roller 135 is integrally connected with the pickup shaft 136, the pickup roller 135 also further rotates together with the pickup shaft 136. This is different than the previous embodiments, where only the pickup roller 135 further rotates.

FIG. 9 shows a velocity-difference controlling mechanism which is provided as a dedicated part, according to another embodiment of the present invention. Referring to FIG. 9, the rotational space S is provided by adding a dedicated insertion member 148 and forming curved surfaces 148*d* at an inner perimeter of the insertion member 148, rather than directly formed at the inner perimeter of the pickup gear 141. The inner perimeter of the insertion member 148 is configured in the same manner as that of the pickup gear 141 of FIG. 8. A reserved space 141*f* for the insertion member 148 is formed in the center portion of the pickup gear 141.

Although in the above description the pickup roller 135 and the photoconductive drum 153 have been used as examples, the present invention can be used to compensate for velocity differences between any two rollers in a paper feeding apparatus. For example, the controlling mechanism of the present invention can be applied to compensate for velocity differences between the photoconductive drum 153 and the heating roller 181 or between the heating roller 181 and the discharging roller 191 (shown in FIG. 2).

Consequently, in an image forming apparatus applying the embodiments of the present invention, the paper 101 picked up by the pickup roller 135 can be directly conveyed to the photoconductive drum 153. Therefore, the paper feeding path can be shortened, reducing the size of the apparatus and the number of parts.

In addition, since the pickup roller 135 rotates slower than the photoconductive drum 153 and additionally rotates as much as the velocity difference generated between the transfer nip P1 and the pickup point P2, the paper can be conveyed at a uniform velocity.

Furthermore, according to the image forming apparatus of the present invention, although two rollers have different velocities, the differences can be compensated for by allowing one of the rollers to further rotate. Accordingly, the paper can be conveyed at a uniform velocity.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image forming apparatus comprising:

a photoconductive drum;

a transferring roller pressed toward the photoconductive drum by a predetermined pressure to transfer an image formed on the photoconductive drum to a paper;

a paper supply part for stacking the paper thereon;

a pickup roller for picking up the paper from the paper supply part and conveying the paper to a nip between the photoconductive drum and the transferring roller; and a pickup shaft inserted in the pickup roller to rotate the pickup roller;

wherein a linear velocity of the pickup shaft is slower than that of the photoconductive drum;

the pickup roller further rotates in a rotational direction of the pickup shaft, undriven by the pickup shaft, after the paper enters the nip between the photoconductive drum and the transferring roller; and the pickup shaft has a substantially polygonal section, and a rotation space is formed at an inner perimeter of the pickup roller to allow the pickup roller to further rotate by a predetermined angle to compensate for the difference in the linear velocities of the photoconductive drum and the pickup roller.

2. The image forming apparatus of claim 1, wherein the predetermined angle is equal to or greater than an angle corresponding to a difference in linear velocity between the pickup roller and the photoconductive drum.

3. The image forming apparatus of claim 1, wherein the rotation space is defined by curved surfaces formed by recessing the inner perimeter of the pickup roller corresponding to corner portions of the pickup shaft.

4. An image forming apparatus comprising:

a photoconductive drum;

a transferring roller pressed toward the photoconductive drum by a predetermined pressure to transfer an image formed on the photoconductive drum to a paper;

a paper supply part for stacking the paper thereon;

a pickup roller for picking up the paper from the paper supply part and conveying the paper directly to a nip between the photoconductive drum and the transferring roller; and a pickup shaft inserted in the pickup roller to rotate the pickup roller, wherein a linear velocity of the pickup shaft is slower than that of the photoconductive drum, and the pickup roller rotates further in a rotational direction of the pickup shaft, undriven by the pickup shaft, to compensate for the difference in the linear velocities of the photoconductive drum and the pickup roller after the paper enters the nip between the photoconductive drum and the transferring roller;

wherein the pickup shaft has a substantially polygonal section, and the pickup roller is mounted to the pickup shaft with an insertion member that includes a rotation space for allowing the pickup roller to be further rotated by a predetermined angle.

5. The image forming apparatus of claim 4, wherein the predetermined angle is equal to or greater than an angle corresponding to a difference in linear velocity between the pickup roller and the photoconductive drum.

6. The image forming apparatus of claim 4, wherein the rotation space is defined by curved surfaces formed by recessing an inner perimeter of the insertion member corresponding to corner portions of the pickup shaft.

* * * * *

UNITED STATES PATENT AND TRADEMARK OFFICE

CERTIFICATE OF CORRECTION

PATENT NO. : 7,570,914 B2
APPLICATION NO. : 11/242083
DATED : August 4, 2009
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 561 days.

Signed and Sealed this

Seventh Day of September, 2010

David J. Kappos

David J. Kappos
*Director of the United States Patent and Trademark Office*